US005851359A

United States Patent [19]

Salminen et al.

[11] Patent Number: 5,851,359

[45] Date of Patent: Dec. 22, 1998

[54] SET OF RIBS IN A DEWATERING DEVICE IN A PAPER MACHINE

[75] Inventors: Samppa Salminen, Jyväskylä; Aimo Närväinen, Palokka, both of Finland

[73] Assignee: Valmet Corporation, Helsinki, Finland

[21] Appl. No.: 878,324

[22] Filed: Jun. 18, 1997

[30] Foreign Application Priority Data

Jun. 18, 1997 [FI] Finland ..... U 960367

[51] Int. Cl.[6] ..... D21F 1/48

[52] U.S. Cl. ..... 162/301; 162/300; 162/352

[58] Field of Search ..... 162/300, 301, 162/352, 374

[56] References Cited

U.S. PATENT DOCUMENTS

| | | | |
|---|---|---|---|
| 1,638,975 | 8/1927 | Antoine | 162/352 |
| 5,061,347 | 10/1991 | Bubik et al. | 162/301 |
| 5,078,835 | 1/1992 | Schiel et al. | 162/352 |
| 5,129,992 | 7/1992 | Schiel et al. | 162/352 |
| 5,221,438 | 6/1993 | Takeuchi | 162/352 |
| 5,262,010 | 11/1993 | Bubik et al. | 162/352 |
| 5,328,570 | 7/1994 | Wolf et al. | 162/336 |
| 5,387,320 | 2/1995 | Jaakkola | 162/301 |
| 5,395,484 | 3/1995 | Odell et al. | 162/203 |
| 5,486,270 | 1/1996 | Schiel | 162/352 |
| 5,690,792 | 11/1997 | Jaakkola et al. | 162/301 |
| 5,695,613 | 12/1997 | Hentila et al. | 162/301 |

FOREIGN PATENT DOCUMENTS

| | | | |
|---|---|---|---|
| 104910 | 8/1925 | Austria | 162/352 |
| 4009627 | 10/1991 | Germany . | |
| 4242658 | 6/1994 | Germany . | |
| 9114826 | 10/1991 | WIPO . | |

OTHER PUBLICATIONS

American Heritage Dictionary, p. 337, definition of "crank", 1982.

*Primary Examiner*—Karen M. Hastings
*Attorney, Agent, or Firm*—Steinberg & Raskin, P.C.

[57] ABSTRACT

A set of ribs in a dewatering device in a paper machine for supporting and/or loading at least one wire in the paper machine and/or doctoring water from the inner face(s) of the at least one wire. The set of ribs includes at least two cross-direction ribs placed at a distance from one another in the machine direction and whose height positions are adjustable. The ribs of the set of ribs are interconnected in pairs by intermediate parts, and by crank mechanisms placed at a distance from one another in the cross direction of the at least one wire so that the ribs are loadable independently from one another.

20 Claims, 3 Drawing Sheets

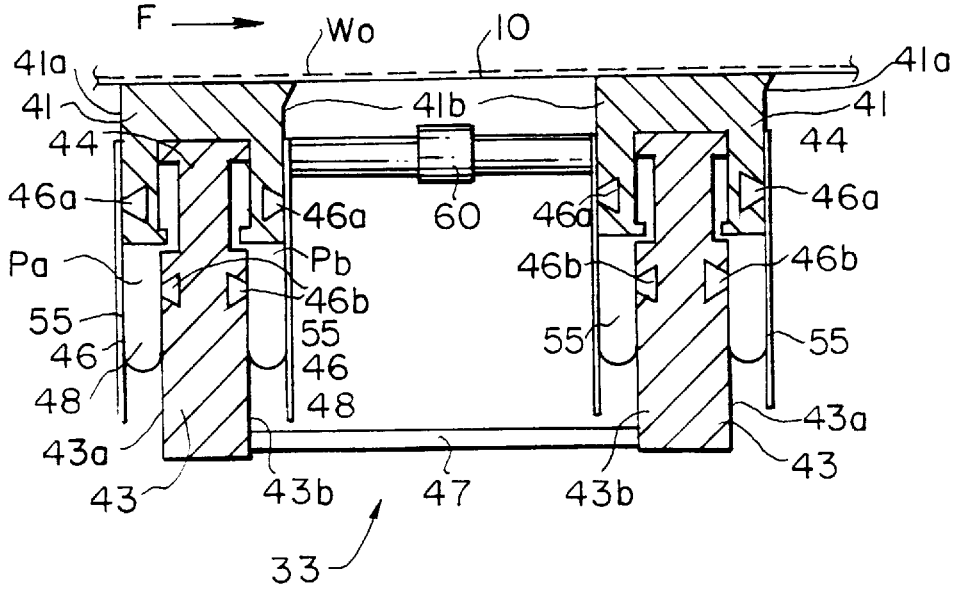
FIG. 2A
FIG. 2B
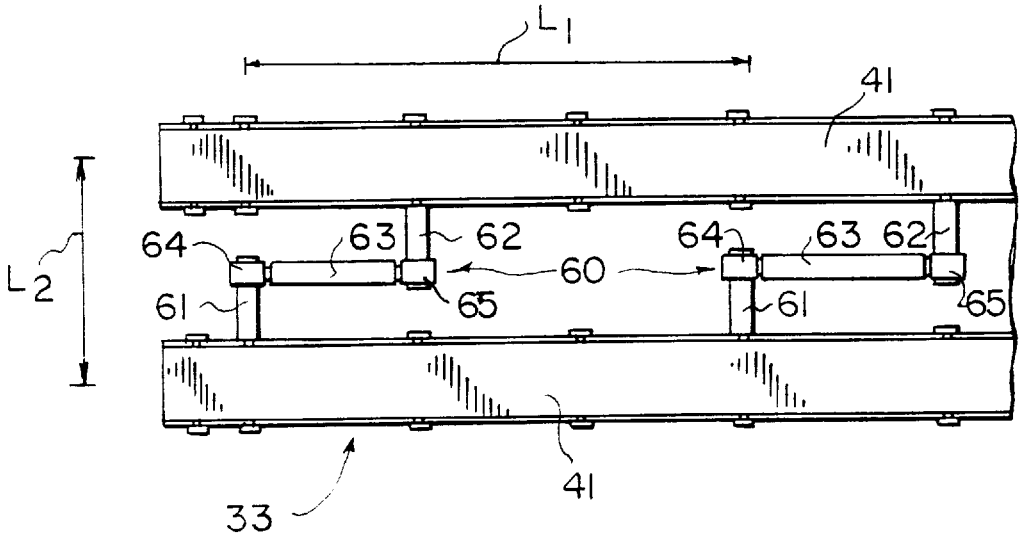

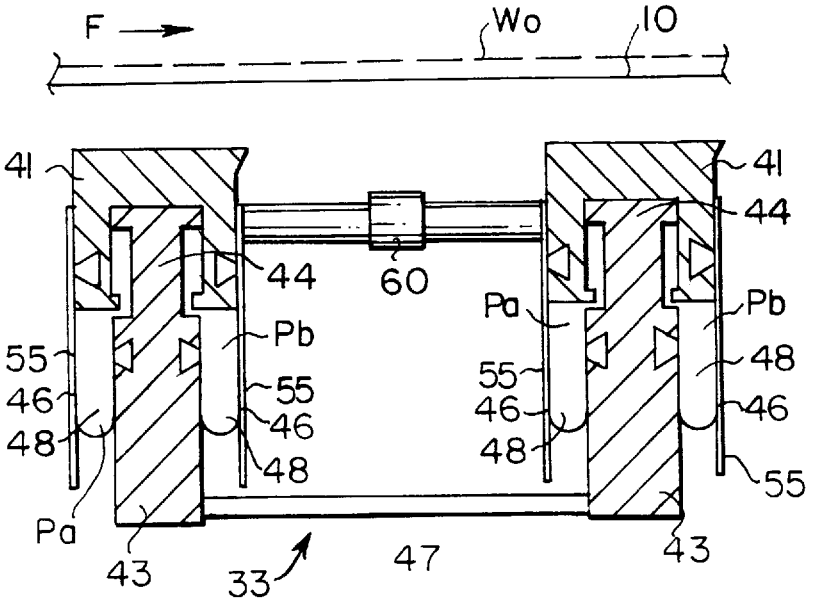
FIG. 3A
FIG. 3B
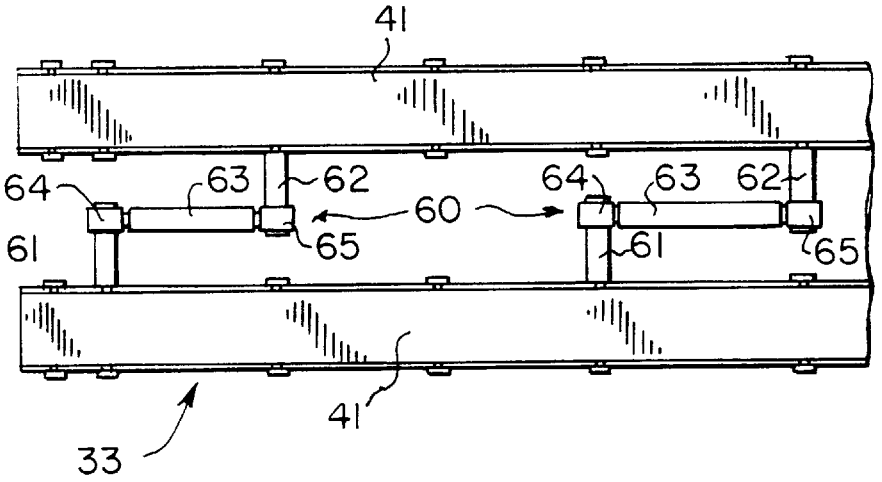

SET OF RIBS IN A DEWATERING DEVICE IN A PAPER MACHINE

FIELD OF THE INVENTION

The present invention relates to a set of ribs in a dewatering device in a paper machine which supports and/or loads at least one wire in the paper machine and/or doctors water from an inner face of the at least one wire. The set of ribs comprises at least two cross-direction ribs, which are placed at a distance from one another in the machine direction, and whose height positions are adjustable. The ribs are interconnected in pairs by means of intermediate parts.

The present invention also relates to a twin-wire forming zone in a web former of a paper machine in which a material web is formed.

BACKGROUND OF THE INVENTION

In web formers in paper machines, a number of different forming members are used. The primary function of these forming members is to produce compression pressure and a pressure pulsation in the fibrous layer, i.e., the web, that is being formed in the web former. By means of the pressure and the pulsation, dewatering of the web that is being formed is promoted and, at the same time, the formation of the web is improved. The forming members include various forming shoes which are usually provided with a curved ribbed deck and over which the forming wires, placed one above the other with the web placed therebetween, curve. In the area of these forming shoes, water is drained from the web through the wire placed at the side of the outside curve by the effect of its tensioning pressure, and this draining is promoted further by a field of centrifugal force. Draining of water also takes place through the wire placed at the side of the inside curve (i.e., more proximate the forming shoe), which draining is generally intensified by means of negative pressure present in a suction chamber of the forming shoe. The ribbed deck of the forming shoe produces pressure pulsation, which both promotes the dewatering and improves the formation of the web.

Further, in the prior art, so-called MB units (loading element units) are known, through which two wires placed one against another run typically as a straight run. In the prior art MB units, pressure loading equipment is arranged inside the loop of one of the wires and draining equipment provided with a set of guide and draining ribs is arranged inside the loop of the other, opposite wire. In a manner known in the prior art, the MB unit is typically placed in the fourdrinier wire portion of a forming section so that the MB unit is preceded by a single-wire portion of considerable length, in which portion a substantial amount of dewatering takes place before the web passes through the MB unit.

In standard prior art MB formers, the lower unit, i.e., the unit in the loop of the lower wire, comprises a support board which includes loaded ribs. Each of these ribs is loaded separately by means of a loading hose of its own.

With regard to the prior art, reference is made to the current assignee's Finnish Patent No. 90,673, corresponding to U.S. Pat. No. 5,387,320 which is incorporated by reference herein, which describes a twin-wire web former of a paper machine. This former comprises a carrying wire and a covering wire which together form a twin-wire forming zone in which a forming unit is arranged. The forming unit comprises a forming board and a water drain box arranged in opposed relationship to the forming board. The water drain box comprises a number of spaced apart ribs whereby water is drained out of the web through the gaps or spaces defined between the ribs into the water drain box to a significant extent by the effect of negative pressure (vacuum) applied to these spaces. In the forming board placed facing the drainage box, there are a number of transverse or cross-direction loading ribs placed at a considerable distance from one another in the machine direction. In the area of the forming unit, the dewatering of the web can be arranged to take place both through the covering wire and through the carrying wire, as well as toward the forming board through the open gaps placed between its loading ribs. In the construction described in FI'673, it has been considered novel that successive loading ribs are interconnected at least in pairs by intermediate parts, and that the intermediate parts, together with the loading ribs attached to them, form ribbed shoes which can be loaded by means of loading hoses to produce a dewatering pressure in the web placed between the wires, while the ribs on the water drain box operate, in a manner in itself known, as back-up members for the loading forces.

In a manner known in the prior art, the ribs are fixedly interconnected, in which connection, when the first rib of a pair of ribs in the running direction of the web and the upper rib placed between the pair of ribs in the opposite wire loop remove water, the stock web becomes thinner, in which case the second rib of the pair of ribs must rise to a level higher than the first rib. It follows from this that the second rib must be loaded to a greater extent than the first rib, in which case the element is turned into an inclined position, and the tips of the ribs are separated from the wire as a result of the change in angle. It is a disadvantage that in such a case, at least one of the ribs does not remove water so that the loading pressure must be increased in order to bring the tip of the rib into contact with the wire. Owing to this employment of an unduly high loading pressure, the base of the paper can also be spoiled. Also, it is quite difficult to operate the second rib with a slight load. It has also been problematic that such ribs cannot be brought into an asynchronous movement.

One solution for these problems is described in the current assignee's Finnish Patent No. 95,058 (corresponding to U.S. Pat. No. 5,690,792, incorporated by reference herein), which describes a set of ribs in a dewatering device in a paper machine which are used to support/load the wire or wires in the paper machine and/or to doctor water from the inner face(s) of the wire or wires. The set of ribs comprises at least two cross-direction ribs placed at a distance from one another in the machine direction, and each of which has an adjustable height position. The ribs in the set of ribs are interconnected in pairs by means of intermediate parts. It has been considered a novel aspect of this set of ribs that the ribs are interconnected in pairs by means of four-joint articulation mechanisms placed at a distance from one another in the cross direction of the wire/wires. By means of these articulation mechanisms, the positions of the ribs in the horizontal direction remain substantially constant irrespective of the relative positions of height of the ribs. However, this construction is not entirely suitable for use in connection with a rib or equivalent in a dewatering device in a paper machine of the type described in Finnish Patent No. 95,935 (corresponding to U.S. Pat. No. 5,695,613, incorporated by reference herein).

Finnish Patent No. 95,935 describes a rib for a dewatering device in a paper machine which supports and/or loads at least one wire in a paper machine and/or doctors water from the face(s) of the at least one wire. The rib is loaded by means of the pressure of a medium. Between the rib and its frame part, a pressure space has been formed, which is defined by a flexible belt and into which the loading pressure is passed. The flexible belt defines the pressure space so that the area of effect of the loading force is independent from the movement of the rib.

OBJECTS AND SUMMARY OF THE INVENTION

It is an object of the present invention to provide a solution by whose means the problems of the prior art ribs in dewatering devices can be solved.

It is a particular object of the present invention to provide a solution which is suitable for use in connection with a rib as described in Finnish Patent No. 95,935 (U.S. Pat. No. 5,695,613) or in connection with a rib of similar type.

It is another object of the present invention to provide a new and improved twin-wire forming zone in a web former including a set of ribs in accordance with the invention.

In view of achieving the objects stated above and others, in a set of ribs for a dewatering device in accordance with the invention, the ribs are interconnected in pairs by means of crank mechanisms placed at a distance from one another in the cross direction of the wire/wires, in which connection the ribs can be loaded independently from one another.

In a loading element in accordance with the invention, the water drain ribs have been interconnected by means of an intermediate pin of a type of a crankshaft, in which connection the ribs can be loaded and displaced independently from one another.

According to a preferred exemplifying embodiment of the invention, when a crankshaft mechanism is used for attaching the ribs in pairs, the angles between the ribs do not change, in which case the faces of the ribs remain in the desired positions relative to the wire and the foil angle remains as desired in the case of each rib, in which connection the ribs can be made to remove water uniformly. Also, in this manner, an efficient and controlled ratio of dewatering/loading is achieved.

As further advantages of the invention, it is achieved that when ribs provided with a clearance angle are used, the clearance angle at each rib remains correct because the crankshaft mechanism prevents turning of one of the ribs into an oblique position.

The arrangement in accordance with the invention is in particular suitable for such dewatering taking place in the wire part in which it is desirable to regulate the loading of the ribs. The arrangement in accordance with the invention is also well suitable for use in projects of modernization of sets of dewatering ribs.

When the web becomes thinner as water is drained, by means of an arrangement in accordance with the invention an increased possibility of regulation of the loading rib is obtained, because each rib can be loaded separately. By means of the number of ribs employed during operation, the quality of the paper is affected, and a suitable number of ribs is selected depending on the paper stock, running speed, and on the thickness of the slice opening in the headbox.

In a general embodiment of the set of ribs which support and/or load at least one wire in the paper machine and/or doctor water from an inner face of at least one wire in accordance with the invention, the set of ribs comprises at least two cross-direction ribs spaced from one another in the machine direction and having adjustable height positions relative to the at least one wire, intermediate parts for interconnecting the at least two ribs in pairs such that at least one pair of interconnected ribs is formed, and at least two crank mechanisms for further interconnecting the ribs of each pair of interconnected ribs. The crank mechanisms are spaced from one another in the cross direction of the wire and structured and arranged to enable independent loading of each rib of each pair of interconnected ribs.

The set of ribs may comprise frame parts, each fixedly coupled to the paper machine and associated with one of the ribs, flexible belts, each coupling one of the ribs to a respective one of the frame parts such that a pressure space is defined between the rib, the frame part and the belt, and pressure loading means for applying a loading pressure into the pressure spaces to load the ribs in a direction toward the wire. In more specific embodiments, flexible belt means each couple one of the ribs to a respective one of the frame parts and each belt means comprises first and second elongate belt sections extending in the longitudinal direction of the respective one of the ribs. Each of the first and second belt sections has first and second longitudinally extending edge regions, the first longitudinally extending edge region of the first and second belt sections being connected to the respective rib and the second longitudinally extending edge region of the first and second belt sections being connected to the respective frame part. Each flexible belt means may further comprise attachment means for attaching the edge of the first longitudinally extending edge region of the first and second belt sections to the respective rib and the edge of the second longitudinally extending edge region of the first and second belt sections to the respective frame part. The attachment means comprise a fastening member having a shaped profile adapted to be fixedly retainable within a cavity of the respective rib and within a cavity of the respective frame part. The first and second belt sections are made of a resilient material such as rubber.

In another embodiment, each rib has first and second longitudinal faces, and the set of ribs further comprises elongate frame parts having first and second longitudinal faces, each fixedly coupled to the paper machine and associated with one of the ribs, and flexible belt means, each coupling one of the ribs to a respective one of the frame parts such that a pressure space is defined between the rib, the frame part and the belt means. Each of the belt means comprises first and second elongate belt sections extending in the longitudinal direction of a respective one of the ribs. Each of the first and second belt sections has first and second longitudinally extending edge regions, the first belt section being attached at the first longitudinally extending edge region to the first longitudinal face of the respective rib and at the second longitudinally extending edge region to the first longitudinal face of the respective frame part and the second elongate belt section being attached at the first longitudinally extending edge region to the second longitudinal face of the rib and at the second longitudinally extending edge region to the second longitudinal face of the frame part. Pressure loading means apply a loading pressure into the pressure spaces to load the ribs in a direction toward the wire.

The twin-wire forming zone in a web former in accordance with the invention comprises means for guiding a first wire in a loop, means for guiding a second wire in a loop such that at least a portion of the second wire runs together with the first wire to thereby define the twin-wire forming zone, a water drain box arranged in the loop of the first wire and comprising loading ribs for loading the first wire, and a set of ribs arranged in the loop of the second wire in opposed relationship to the water drain box such that one of the ribs of the water drain box is arranged in opposed relationship to a gap defined between an adjacent pair of the ribs of the set of ribs. The set of ribs comprises at least two cross-direction ribs spaced from one another in the machine direction and having adjustable height positions relative to the at least one wire, intermediate parts for interconnecting the at least two ribs in pairs such that at least one pair of interconnected ribs is formed, and at least two crank mechanisms for further interconnecting the ribs of each of the at least one pair of interconnected ribs. The at least two crank mechanisms are spaced from one another in the cross direction of the wire and structured and arranged to enable independent loading of each of the ribs of each of the at least one pair of interconnected ribs. The set of ribs and crank mechanism in the twin-wire zone may include all of the features described herein.

In the following, the invention will be described in more detail with reference to the figures in the accompanying drawings. However, the invention is not strictly confined to the details of the illustrated embodiments.

BRIEF DESCRIPTION OF THE DRAWINGS

Additional objects of the invention will be apparent from the following description of the preferred embodiment thereof taken in conjunction with the accompanying non-limiting drawings, in which:

FIGS. 2A and 2B are schematic illustrations of a loading element in accordance with the invention in a loading position; and FIGS. 3A and 3B are schematic illustrations of a loading element in accordance with the invention in a non-loaded position.

DETAILED DESCRIPTION OF THE PREFERRED EMBODIMENTS

Figure 1:
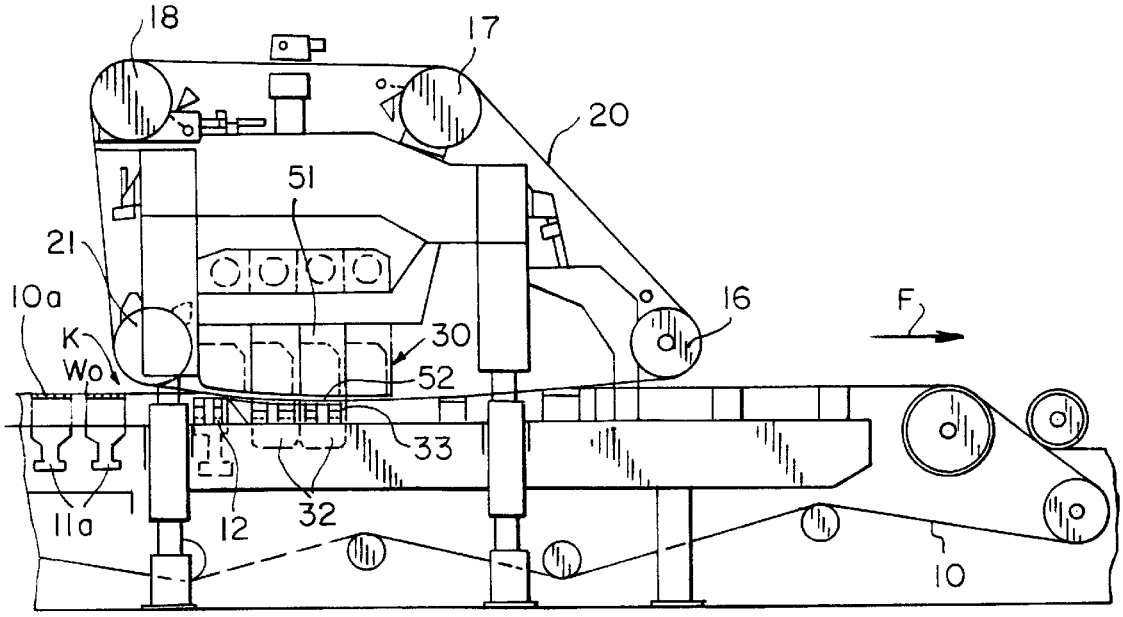
FIG. 1 is a schematic illustration of an exemplifying embodiment of an environment of application of the invention.

Referring to FIGS. 1–3B wherein like reference numerals refer to the same or similar elements, FIG. 1 is a schematic illustration of an environment of application of the present invention which includes a former comprising a lower wire 10 arranged to run in a loop and an upper wire 20 arranged to run in a loop. In connection with the loop of the lower wire 10, after the headbox (not shown), there is the single-wire initial portion 10*a* of the web forming zone in which draining elements 11*a* are placed and operated to dewater the stock web until the stock web $W_0$ attains a certain dry solids content, and at least its lower face receives a certain couching degree before the web enters into a subsequent twin-wire zone which is formed between the wires 10 and 20. The twin-wire zone starts at a breast roll 21 arranged in the loop of the upper wire 20. After the breast roll 21, the twin-wire zone includes a forming shoe 12 arranged inside the loop of the lower wire 10 and a loading unit 32 of an MB unit 30 arranged after the forming shoe 12 in the traveling or running direction of the wires 10,20. In the loading unit 32, there are loading ribs which are arranged one after the other in the machine direction, i.e., sequentially arranged and extend across substantially the entire width of the wires 10,20. At least some of the loading ribs in the loading unit 32 are interconnected in pairs, although some ribs in the loading unit 32 may also be individual ribs or connected in units of more than two.

The upper wire 20 is arranged to run over several turning/reversing rolls 16, 17, 18 and over the breast roll 21 and the lower wire 10 is arranged to run substantially parallel to the upper wire 20 underneath the upper wire 20 in the twin-wire zone. The wires 10 and 20 form a wedge-shaped inlet gap K in which the web $W_0$ placed on the lower wire 10 is pressed continuously between the wires 10 and 20 as the wires make progress in the direction of travel of the wires 10,20. After the wedge-shaped inlet gap K, in a transfer direction F, there is the MB unit 30 which comprises an upper dewatering or water drain box 51 and the loading units 32. The bottom of the water drain box 51 comprises ribs 52 and water is sucked or drawn out of the web $W_0$ through gaps or spaces defined between the ribs 52 into the dewatering box 51 by means of a vacuum and air. On its run, the upper wire 20 rests against the ribs 52. The MB unit 30 also includes the loading units 32 which permit dewatering to take place in a downward direction. On the top face of each loading unit 32, there are one or more sets of loading ribs 33. Above the sets of loading ribs 33 and inside the loop of the upper wire 20, ribs 52 are arranged to face the gaps between the ribs in the sets of loading ribs 33 and serve as backup parts for the pressure loading. Further, FIG. 1 shows a number of other parts and support structures included in the former, which parts and structures are known in themselves and will not be described in further detail in this application.

In the exemplifying embodiments shown in FIGS. 2A,2B, 3A and 3B, the set of loading ribs 33 comprises two loading ribs 41. Each loading rib 41 comprises a frame part 43 on which the loading rib 41 is supported by means of a glide rail or part 44. The loading rib 41 is arranged to move in the vertical direction while supported by the glide part 44. The planar top faces or sides of the loading ribs 41 glide against the wire 10,20 face and load the wires while water operates as a lubricant. By means of the loading ribs 41, water drained from the web $W_0$ is doctored off the lower face of the wire. The loading rib 41 is supported in its place of operation typically by means of a continuous glide rail 44, which is made integral with the frame part 43. Preferably, flexible belt means couple the loading rib 41 to the frame part 43 and comprise two elongate belt sections 46 extending in the direction of the loading rib 41. Each belt section 46, also referred to herein as a belt, has first and second longitudinally extending edge regions 46*a*,46*b* whereby the first longitudinally extending edge region 46*a* is attached to a respective one of the exterior edges or sides of the loading rib 41 and the second longitudinally extending edge region 46*b* is attached and to the frame part 43 at a respective side thereof so that U-shaped loops 48 are formed downwards. In other words, each first longitudinally extending edge region 46*a* is attached to a respective longitudinal face 41*a*,41*b* of the loading rib 41 and each second longitudinally extending edge region 46*b* is attached to a respective longitudinal face 43*a*,43*b* of the frame part 42. Shield plates 55 are attached to the sides of the rib 41 outside the belt 46 and restrict the movement of the belt 46 toward the sides.

In the construction shown in FIGS. 2A,2B, 3A and 3B, the loading force is produced by passing the loading pressure $P_a$,$P_b$ by means of a medium, for example air, into the space defined by the flexible belt 46, the rib 41, and the frame part 43. The loading pressure $P_a$,$P_b$ is relieved by lowering the pressure $P_a$,$P_b$ and the force of gravity returns the rib 41 down. The belt 46, whose thickness is, for example, from about 0.1 mm to about 3 mm, preferably from about 1 mm to about 2 mm, and which is made of rubber or any other, equivalent resilient material, is attached from its upper edge 46*a* to the rib 41 and from its lower edge 46*b* to the frame part 43 so that the U-shaped loops 48 are formed downwards, which loops permit movement of the rib 41 in a vertical direction (up and down in the illustrated embodiment). Lateral supports such as the shield plates 55 restrict the expansion of the belt 46 toward the sides, in which case the area of effect of the pressure is not changed when the rib 41 moves in the loading direction.

As shown, the ribs 41 are interconnected in pairs by means of a crank mechanism 60, and the frames 43 of the interconnected ribs are further connected by means of an intermediate part 47 attached to both ribs of the pair. More specifically, the bottom portions of the frames 43 of the rib 41 are interconnected by means of intermediate part support rods 47. The top portions of the loading ribs 41 are interconnected by means of the crank mechanism 60 which permits separate and independent loading of each rib 41, i.e., without affecting the loading of the other rib of the pair, and which further secures that the positions of the ribs 41 in relation to the web $W_0$ remain as desired. The crank mechanisms 60 are placed at a distance $L_1$ from one another in the cross direction of the machine, which distance is from about 50 mm to about 500 mm. The distance $L_2$ between the ribs 41 is from about 30 mm to about 300 mm.

The crank mechanism 60 comprises an arm part 61 attached to a first rib 41 of a pair of interconnected ribs and, similarly, an arm part 62 attached to the other rib 41 of the interconnected pair, and an intermediate crank arm 63, which is linked with the arm parts 61,62 by means of articulated joints 64,65. In view of the articulation of the arm parts 61,62 with respect to the crank arm 63 and the freedom of movement provided thereby, loading of one of the ribs in an interconnected pair will not significantly affect the loading of the other rib of the pair.

In the loading position shown in FIGS. 2A and 2B, the crank mechanism 60 is in the upper position, and in the stage shown in FIGS. 3A and 3B, the crank mechanism 60 is in the lower position.

In the following, the patent claims will be given, and the various details of the invention can show variation within the scope of the inventive idea defined in the claims and differ even to a considerable extent from the details stated above by way of example only. As such, the examples provided above are not meant to be exclusive and many other variations of the present invention would be obvious to those skilled in the art, and are contemplated to be within the scope of the appended claims.

We claim:

1. In a set of ribs in a dewatering device in a paper machine, the set of ribs comprising at least two cross-direction ribs for supporting and/or loading at least one wire in the paper machine and/or doctoring water from an inner face of at least one wire, said ribs being spaced from one another in the machine direction, loading means for loading said ribs such that said ribs have adjustable height positions relative to the at least one wire, and intermediate parts for interconnecting said at least two ribs in pairs such that at least one pair of interconnected ribs is formed, the improvement comprising at least two crank mechanisms for further interconnecting said ribs in each of said at least one pair of interconnected ribs, said at least two crank mechanisms being spaced from one another in the cross direction of the wire and structured and arranged to enable independent loading of each of said ribs in each of said at least one pair of interconnected ribs.

2. The set of ribs of claim 1, wherein each of said at least two crank mechanisms comprises a first arm part connected to a first one of said ribs in each of said at least one pair of interconnected ribs and a second arm part connected to a second one of said ribs in each of said at least one pair of interconnected ribs, and a crank arm for connecting said first and second arm parts.

3. The set of ribs of claim 2, wherein said first and second arm parts are articulatably connected to said crank arm to define articulated joints between each of said first and second arm parts and said crank arm.

4. The set of ribs of claim 1, wherein said at least two crank mechanisms are placed at a distance from one another in the cross direction, said distance being in a range from about 50 mm to about 500 mm.

5. The set of ribs of claim 1, further comprising frame parts, each fixedly coupled to the paper machine and associated with one of said ribs, said intermediate parts being connected to said frame parts, and flexible belt means, each coupling one of said ribs to a respective one of said frame parts such that a pressure space is defined between said rib, said frame part and said belt means, each of said belt means comprising first and second elongate belt sections extending in the longitudinal direction of the respective one of said ribs, each of said first and second belt sections having first and second longitudinally extending edge regions, said first longitudinally extending edge region of said first and second belt sections being connected to said respective rib and said second longitudinally extending edge region of said first and second belt sections being connected to said respective frame part, said loading means comprising pressure loading means for applying a loading pressure into said pressure spaces to load said ribs in a direction toward the at least one wire.

6. The set of ribs of claim 1, further comprising frame parts, each fixedly coupled to the paper machine and associated with one of said ribs, and flexible belts, each coupling one of said ribs to a respective one of said frame parts such that a pressure space is defined between said rib, said frame part and said belt, said loading means comprising pressure loading means for applying a loading pressure into said pressure spaces to load said ribs in a direction toward the wire.

7. The set of ribs of claim 6, further comprising glide rails, each connected to one of said frame parts for supporting a respective one of said ribs in the cross direction.

8. The set of ribs of claim 5, wherein each of said flexible belt means further comprises attachment means for attaching the edge of said first longitudinally extending edge region of said first and second belt sections to said respective rib and the edge of said second longitudinally extending edge region of said first and second belt sections to said respective frame part, said attachment means comprising a fastening member having a shaped profile adapted to be fixedly retainable within a cavity of said respective rib and within a cavity of said respective frame part.

9. The set of ribs of claim 5, further comprising lateral supports attached to each of said ribs for restricting movement of said first and second belt sections in a direction transverse to the longitudinal direction of said rib.

10. The set of ribs of claim 5, wherein said first and second belt sections are made of a resilient material.

11. The set of ribs of claim 5, wherein said first and second belt sections are made of rubber.

12. The set of ribs of claim 1, wherein each of said ribs has first and second longitudinal faces, further comprising elongate frame parts having first and second longitudinal faces, each fixedly coupled to the paper machine and associated with one of said ribs, and flexible belt means, each coupling one of said ribs to a respective one of said frame parts such that a pressure space is defined between said rib, said frame part and said belt means, each of said belt means comprising first and second elongate belt sections extending in the longitudinal direction of a respective one of said ribs, each of said first and second belt sections having first and second longitudinally extending edge regions, said first belt section being attached at said first longitudinally extending edge region to said first longitudinal face of said respective rib and at said second longitudinally extending edge region to said first longitudinal face of said respective frame part and said second elongate belt section being attached at said first longitudinally extending edge region to said second longitudinal face of said rib and at said second longitudinally extending edge region to said second longitudinal face of said frame part, said loading means comprising pressure loading means for applying a loading pressure into said pressure spaces to load said ribs in a direction toward the wire.

13. A twin-wire forming zone in a web former, comprising means for guiding a first wire in a loop, means for guiding a second wire in a loop such that at least a portion of said second wire runs together with said first wire to thereby define the twin-wire forming zone, a water drain box arranged in said loop of said first wire and comprising loading ribs for loading said first wire, and a set of ribs arranged in said loop of said second wire in opposed relationship to said water drain box such that one of said ribs of said water drain box is arranged in opposed relationship to a gap defined between an adjacent pair of said ribs of said set of ribs, said set of ribs comprising at least two cross-direction ribs spaced from one another in the machine direction, loading means for loading said ribs such that said ribs have adjustable height positions relative to said second wire, intermediate parts for interconnecting said at least two ribs in pairs such that at least one pair of interconnected ribs is formed, and at least two crank mechanisms for further interconnecting said ribs in each of said at least one pair of interconnected ribs, said at least two crank mechanisms being spaced from one another in the cross direction of the wire and structured and arranged to enable independent loading of each of said ribs in each of said at least one pair of interconnected ribs.

14. The twin-wire zone of claim 13, wherein each of said at least two crank mechanisms comprises a first arm part connected to a first one of said ribs in each of said at least one pair of interconnected ribs and a second arm part connected to a second one of said ribs in each of said at least one pair of interconnected ribs, and a crank arm for connecting said first and second arm parts.

15. The twin-wire zone of claim 14, wherein said first and second arm parts are articulatably connected to said crank arm to define articulated joints between each of said first and second arm parts and said crank arm.

16. The twin-wire zone of claim 13, wherein said at least two crank mechanisms are placed at a distance from one another in the cross direction, said distance being in a range from about 50 mm to about 500 mm.

17. The twin-wire zone of claim 13, further comprising frame parts, each fixedly coupled to the paper machine and associated with one of said ribs, and flexible belt means, each coupling one of said ribs to a respective one of said frame parts such that a pressure space is defined between said rib, said frame part and said belt means, each of said belt means comprising first and second elongate belt sections extending in the longitudinal direction of the respective one of said ribs, each of said first and second belt sections having first and second longitudinally extending edge regions, said first longitudinally extending edge region of said first and second belt sections being connected to said respective rib and said second longitudinally extending edge region of said first and second belt sections being connected to said respective frame part, said loading means comprising pressure loading means for applying a loading pressure into said pressure spaces to load said ribs in a direction toward said second wire.

18. The twin-wire zone of claim 13, further comprising frame parts, each fixedly coupled to the paper machine and associated with one of said ribs, and flexible belts, each coupling one of said ribs to a respective one of said frame parts such that a pressure space is defined between said rib, said frame part and said belt, said loading means comprising pressure loading means for applying a loading pressure into said pressure spaces to load said ribs in a direction toward said second wire.

19. The twin-wire zone of claim 17, wherein each of said flexible belt means further comprises attachment means for attaching the edge of said first longitudinally extending edge region of said first and second belt sections to said respective rib and the edge of said second longitudinally extending edge region of said first and second belt sections to said respective frame part, said attachment means comprising a fastening member having a shaped profile adapted to be fixedly retainable within a cavity of said respective rib and within a cavity of said respective frame part.

20. The twin-wire zone of claim 13, wherein each of said ribs has first and second longitudinal faces, further comprising elongate frame parts having first and second longitudinal faces, each fixedly coupled to the paper machine and associated with one of said ribs, and flexible belt means, each coupling one of said ribs to a respective one of said frame parts such that a pressure space is defined between said rib, said frame part and said belt means, each of said belt means comprising first and second elongate belt sections extending in the longitudinal direction of a respective one of said ribs, each of said first and second belt sections having first and second longitudinally extending edge regions, said first belt section being attached at said first longitudinally extending edge region to said first longitudinal face of said respective rib and at said second longitudinally extending edge region to said first longitudinal face of said respective frame part and said second elongate belt section being attached at said first longitudinally extending edge region to said second longitudinal face of said rib and at said second longitudinally extending edge region to said second longitudinal face of said frame part, said loading means comprising pressure loading means for applying a loading pressure into said pressure spaces to load said ribs in a direction toward said second wire.

* * * * *

UNITED STATES PATENT AND TRADEMARK OFFICE

CERTIFICATE OF CORRECTION

PATENT NO. : 5,851,359

DATED : December 22, 1998

INVENTOR(S) : Samppa SALMINEN, et al.

It is certified that error appears in the above-identified patent and that said Letters Patent is hereby corrected as shown below:

On the title page,

Under [30] Foreign Application Priority Data , change

Jun. 18, 1997 to --Jun. 18, 1996--

Signed and Sealed this

Thirtieth Day of March, 1999

*Attest:*

*Attesting Officer*

Q. TODD DICKINSON

*Acting Commissioner of Patents and Trademarks*